US006731769B1

(12) United States Patent
Lenhardt

(10) Patent No.: US 6,731,769 B1
(45) Date of Patent: May 4, 2004

(54) UPPER AUDIO RANGE HEARING APPARATUS AND METHOD

(75) Inventor: Martin L. Lenhardt, Hayes, VA (US)

(73) Assignee: Sound Techniques Systems LLC, Washington, DC (US)

( * ) Notice: Subject to any disclaimer, the term of this patent is extended or adjusted under 35 U.S.C. 154(b) by 0 days.

(21) Appl. No.: 09/417,771

(22) Filed: Oct. 14, 1999

Related U.S. Application Data

(60) Provisional application No. 60/104,300, filed on Oct. 14, 1998.

(51) Int. Cl.[7] ..... H04R 25/00

(52) U.S. Cl. ..... 381/316; 381/320; 381/326

(58) Field of Search ..... 381/312, 316, 381/320, 321, 326, 328, 380, 98

(56) References Cited

U.S. PATENT DOCUMENTS

| | | | | | |
|---|---|---|---|---|---|
| 3,563,246 | A | * | 2/1971 | Puharich et al. | 331/47 |
| 3,629,521 | A | * | 12/1971 | Puharich et al. | 381/151 |
| 3,752,939 | A | * | 8/1973 | Bartz | 381/312 |
| 3,781,491 | A | | 12/1973 | Biondi et al. | 179/107 R |
| 4,052,572 | A | * | 10/1977 | Schafer | 381/315 |
| 4,289,935 | A | * | 9/1981 | Zollner et al. | 607/57 |
| 4,327,252 | A | | 4/1982 | Tomatis | 179/1 N |
| 4,403,118 | A | * | 9/1983 | Zollner et al. | 381/101 |
| 4,629,834 | A | * | 12/1986 | Waggoner et al. | 381/316 |
| 4,667,683 | A | * | 5/1987 | Dugot | 600/559 |
| 4,776,322 | A | * | 10/1988 | Hough et al. | 381/326 |
| 4,982,434 | A | * | 1/1991 | Lenhardt et al. | 381/316 |
| 5,047,994 | A | * | 9/1991 | Lenhardt et al. | 367/116 |
| 5,285,499 | A | | 2/1994 | Shannon et al. | 381/68 |
| 5,663,727 | A | * | 9/1997 | Vokac | 341/132 |
| 5,812,598 | A | * | 9/1998 | Sharma et al. | 375/259 |
| 6,169,813 | B1 | * | 1/2001 | Richardson et al. | 381/312 |
| 6,173,062 | B1 | * | 1/2001 | Dibachi et al. | 381/312 |
| 6,250,255 | B1 | * | 6/2001 | Lenhardt et al. | 119/713 |
| 6,259,951 | B1 | * | 7/2001 | Kuzma et al. | 600/57 |

FOREIGN PATENT DOCUMENTS

DE 19525944 A1 1/1997

* cited by examiner

*Primary Examiner*—Curtis Kuntz
*Assistant Examiner*—P. Dabney
(74) *Attorney, Agent, or Firm*—Heller Ehrman White & McAuliffe

(57) ABSTRACT

A system and method upper auditory frequency range hearing. A speech signal is filtered, and then modulated to an upper auditory frequency range. The modulated signal is then provided to a transducer, which causes a vibration in the ear canal, the head or the neck of a user, which is received in an inner ear of the user. That vibration is translated as a signal to the brain, which interprets that signal as intelligible speech.

8 Claims, 12 Drawing Sheets

UAR WORD DISCRIMINATION
SINGLE vs. DUAL CHANNEL PROCESSING
1 CHANNEL
2 CHANNEL
hl 1 CHAN
hl 2 CHAN
hl = HEARING LOSS SUBJECT
%
100
90
80
70
60
50
40
30
20
10
0
20 kHz
24 kHz

UPPER AUDIO RANGE HEARING APPARATUS AND METHOD

This application claims priority of U.S. Provisional Application No. 60/104,300 filed in the United States Patent and Trademark Office on Oct. 14, 1998, the entirety of which is incorporated by reference.

BACKGROUND OF THE INVENTION

1. Field of the Invention

The present invention relates to an upper audio range (UAR) hearing apparatus and method that converts speech waveform envelope into upper audio frequencies (>10 kHz), for delivery to the ear, or skin of the head or neck, which are then provided to the inner ear and then the brain.

2. Description of the Related Art

Conventional air conduction hearing aids only amplify either the entire speech signal or certain portions, or frequency bands, or the speech signal. The most intense part of speech is the fundamental frequency derived from action of the vocal folds. Higher frequencies are derived from vocal tract resonance, but their intensities are lower than those of the fundamental frequency.

The relatively lower intensity, higher frequency speech sounds are generally consonants. Consonants carry most of the information in speech, and are important for normal speech perception. In the cases of sensorineural hearing loss, consonant detection is altered, as is intelligibility. As mentioned above, conventional aid conduction hearing aids focus on amplifying all or portions of the speech spectrum to regain intelligibility for persons with hearing loss. Conventional air conduction hearing aids are ineffective at some degree of hearing loss, depending on the nature of the loss and the individual differences. Alternative approaches have included using frequency bands not compromised by the hearing loss. One approach, disclosed in U.S. Pat. No. 4,982,434, involves frequency-converting the speech to an ultrasonic region (>30,000 Hz), while another approach involves frequency transposition focusing the speech into a bass region (<300 Hz). The upper audio range, from about 10,000 Hz to 29,999 Hz, has been neglected.

SUMMARY OF THE INVENTION

The invention is directed to a hearing aid, which includes a plurality of channels for receiving an input speech signal, one of the channels filtering the speech signal with a first filter centered at a first predetermined audio frequency and having a first predetermined filter bandwidth, another of the channels filtering the speech signal with a second filter centered at a second predetermined audio frequency and having a second filter bandwidth. The hearing aid also includes an envelope extraction unit for extracting an envelope of an output of each of the channels, and a multichannel frequency multiplication unit for performing a modulation of each of the envelopes obtained from the output of each of the channels using a carrier that is in an upper audio frequency range. The hearing aid further includes a transducer unit for providing vibration and sound in the ear canal or preferably as a vibration to the skin of a user based on the modulated envelopes.

BRIEF DESCRIPTION OF THE DRAWINGS

The above-mentioned object and advantages of the invention will become more fully apparent from the following detailed description when read in conjunction with the accompanying drawings, with like reference numerals indicating corresponding parts throughout, and wherein.

DETAILED DESCRIPTION OF THE PREFERRED EMBODIMENTS

Figure 1:
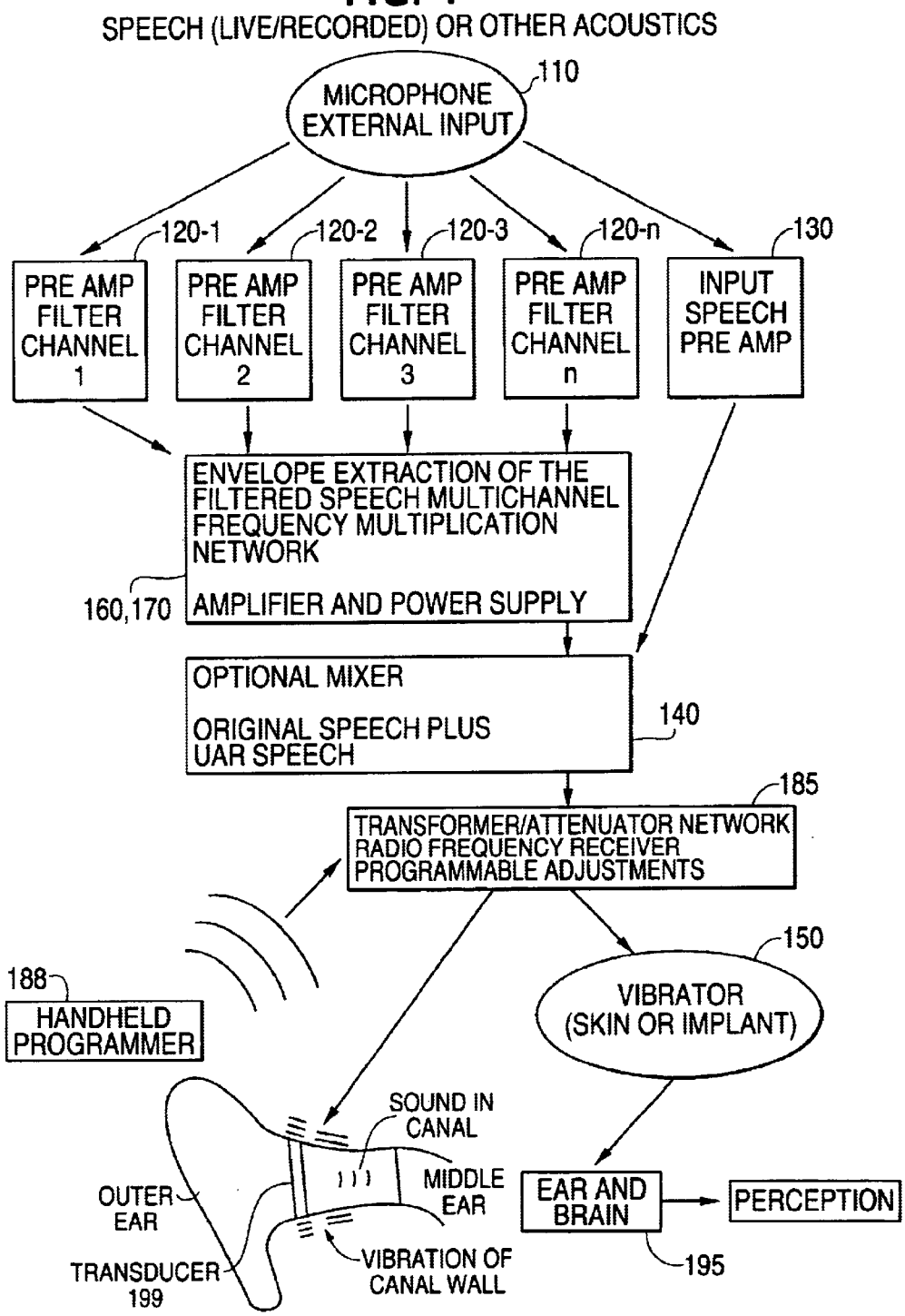
FIG. 1 is a block diagram of an upper audio hearing aid according to one embodiment of the invention.

The embodiments of the invention are directed to a method and a system for upper audio range hearing. An upper audio range hearing device according to the invention converts speech waveform envelope into the upper audio frequencies, ≧10 kHz, for delivery into the ear canal or to the head or neck of a user and eventually into the inner ear. The device can be single or multi-channeled, such that in the multi-channeled configuration, a plurality of signals that are extracted from the original speech waveform are processed to be each converted to upper audio frequency signals. Since the signals are all derived from the same source, they are coherent and can be correlated temporally by the brain into intelligible speech. In several embodiments of the invention, the speech signal is converted to the upper audio frequency range by one of amplitude modulation, frequency modulation, or by other means in either analog or digital form. If only a single channel is desired, then it can be selected from the plurality of channels based on frequency content. The upper audio range signals also can be combined with the original speech waveform, either in its natural form or amplified form, to enhance intelligibility in the hearing impaired. The upper audio frequency signal is provided by way of a transducer, such as a piezoelectric device, which vibrates in the upper audio frequency range. The transducer is preferably positioned on the skin of the patient near the ear, but alternatively the transducer can be implanted in the middle or inner ear, such that the upper audio range speech waveform is directly provided to the ossicle, or window or wall of the inner ear. The transducer can alternatively be placed into the ear canal, such that the result is vibratory and sound waves. In this alternative, the output will be sound in the ear canal and vibration in the canal wall to which the transducer touches. Furthermore, a transducer in the inner ear and a transducer on the head or neck may be utilized as another alternative.

According to the invention, a series of filters extract envelope information from a broadband speech signal. Each channel carries separate amplitude information based on the passband of the filter in that channel. The signal in each channel is multiplied by an upper audio range (UAR) carrier. At least one of the filters is preferably set in the vowel frequency range, for example 500 Hz. At least another of the filters is preferably set in the range of high frequency consonants, for example 3.1 kHz. The lowest frequency channel (fundamental vocal frequency) can be presented as low-pass-amplified sound. In one embodiment, the lowest frequency channel is directly provided to the transducer, and in another embodiment, the lowest frequency channel is multiplied by a carrier to the upper audio frequency range. The outputs of the multiple channels are amplified, and delivered via transformers to skin vibrators, or transducers. Outputs of the channels may be mixed or combined prior to output to a single transformer and a single transducer. Alternatively, the outputs of the channels may be individually attenuated (shaped) or presented separately to an array of transducers—one for each channel output. The transducer array may be phase or otherwise manipulated to result in an acceptable sound image for the listener.

The embodiments of the invention have been developed based on the fact that clinical hearing is not generally measured above 10,000 Hz because there is little speech above 6,000 Hz. Thus, while human hearing is present above 10,000 Hz, it is often neglected. There is early hearing loss in this region due to aging, noise or toxicity. Hearing in this range is sometimes monitored to assess insult such as toxicity, but little else. The upper range of normal human hearing for air conducted sound is generally accepted to be about 20,000 Hz, although there have been some reports of human hearing up to about 26,000 Hz. In any event, the threshold of hearing increases rapidly from 10,000 to 26,000 Hz. This range can be exploited by either air pressure in the canal or vibration of the head and inner ear.

Upper audio range frequencies, while caring little direct speech energy, are used in the embodiments of the invention to deliver speech information to the inner ear. If the conventional speech frequencies (100 Hz to 6000 Hz) are shifted such that the fundamental vocal frequency ($f_0$) is now in the UAR frequencies (either by some form of amplitude modulation, frequency modulation, or synthetic generation), the ear will be stimulated and speech perception will occur.

The embodiments of the invention transmit the multiplied speech to the skin of the head or neck of the user. The vibrations pass into the inner ear by bone or fluid conduction. While the complete method of transduction at possible inner ear sites is not completely understood at present and need not be known in order to practice the invention, the cochlea and possibly part of the vestibular system is activated. Direct stimulation of nerve VIII that provides speech signals to the brain is less likely, but possible due to the piezoelectric nature of the head anatomy. The UAR signal that is provided to a vibration unit according to the invention is complementary to normal air conduction hearing, and may serve as a reinforcement of speech perception under poor listening conditions, such as in areas where there is high ambient noise.

In a first embodiment, a single channel is used to shift up the speech to the upper auditory range, via amplitude modulation, upper-sideband modulation, double-sideband modulation, frequency modulation, or the like, to thereby create an upper auditory range signal. That signal is amplified and then provided to a transducer, which is disposed in the ear canal or on the head or neck of a user, and which outputs a vibration to the user that is received in the inner ear. That vibration is transferred to the auditory cortex of the brain, where it is interpreted as speech.

Figure 2:
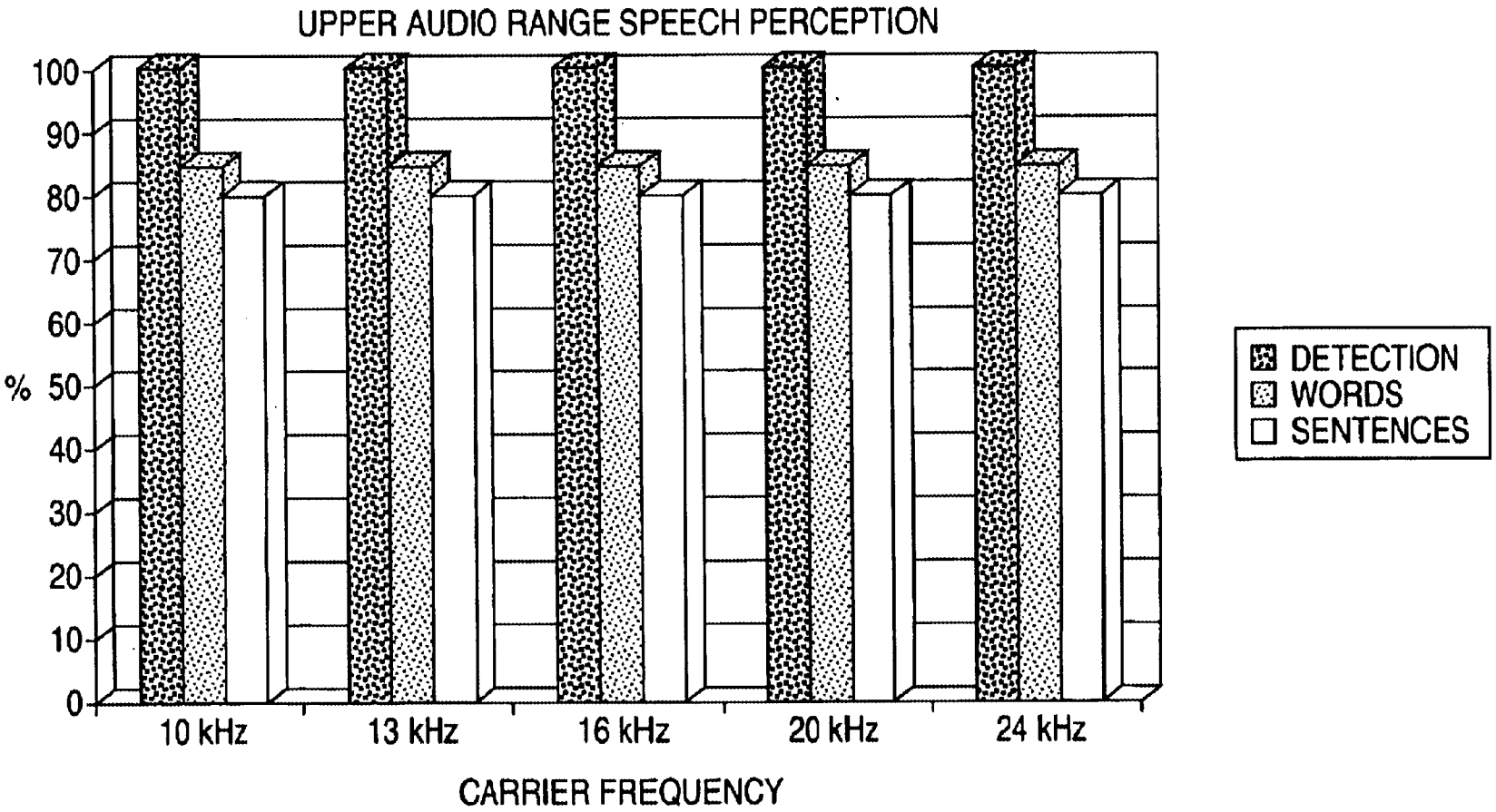
FIG. 2 shows speech perception for various upper audio carrier frequencies used in an upper audio range hearing aid according to the invention.
Figure 3:
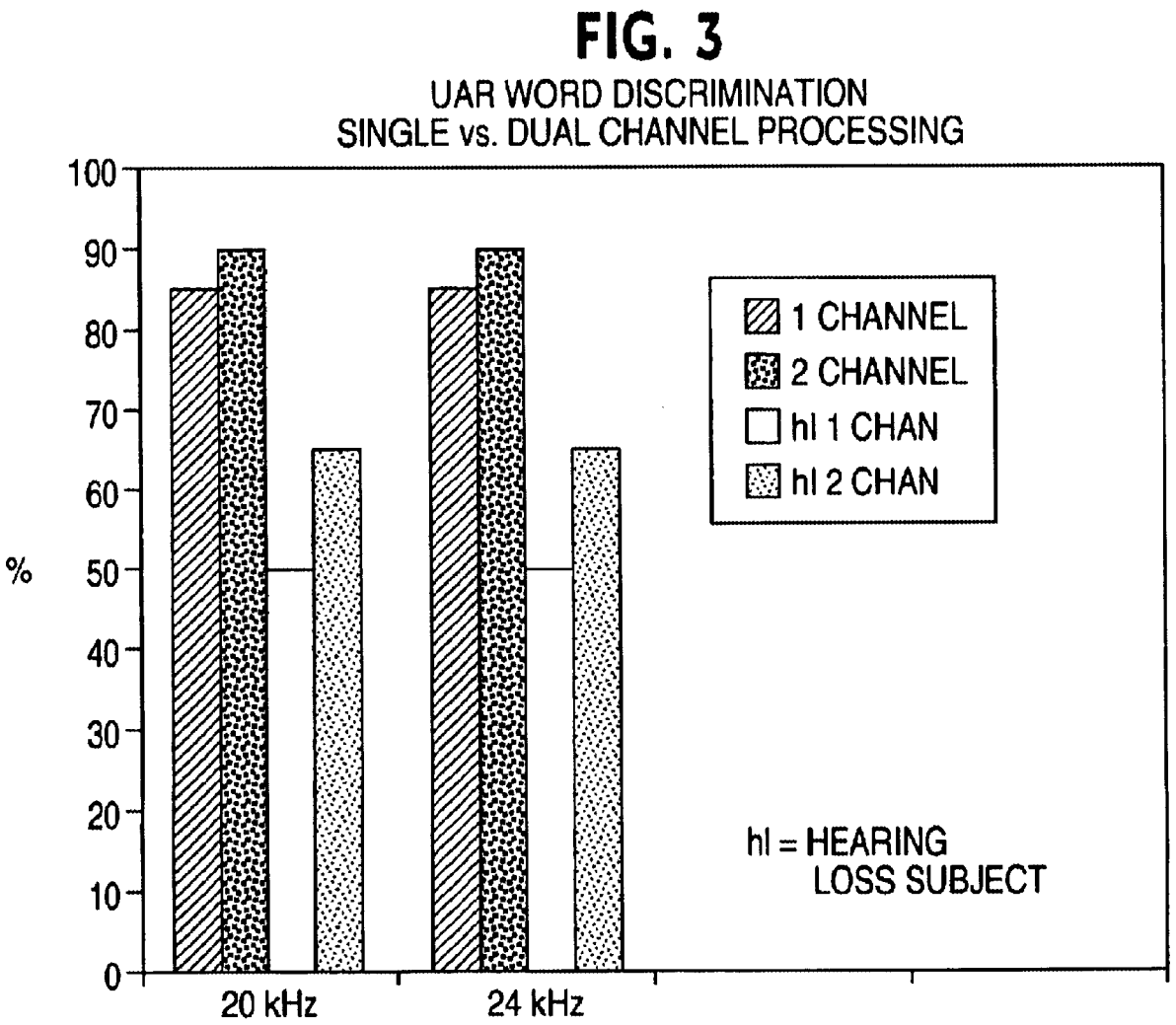
FIG. 3 shows word discrimination for both a single- and a dual-channel upper audio range hearing aid according to the invention.

In a second embodiment, a plurality of channels are used, such that different frequencies, such as the consonant frequencies that are often overshadowed by the higher-intensity (but lower frequency) vowel frequencies, can be emphasized. By doing so with a plurality of filters and amplifiers, high and low frequency consonant sounds can be processed to have better perceptual salience. Vowel sounds, typically having about 20 dB more energy in the original signal than consonant sounds, may overpower those consonant sounds if only a single channel is used, as in the first embodiment. Thus, the second embodiment provides better speech perception, but at the cost of greater size and power consumption. This better speech perception of the second embodiment as compared to the first embodiment can be seen from the charts shown in FIGS. 2 and 3.

In the second embodiment, the channels do not necessarily have to be integrated, because the ear and brain fuse the information into a single percept. That is, the outputs of each of the channels can be separately provided to a corresponding transducer, and each transducer may then provide a vibration based on the UAR speech in the channel connected to that transducer. The outputs of the plurality of transducers are received by the inner ear and transferred as signals to the brain (by way of nerve VIII), where they are perceived as speech. Alternatively, the outputs of the channels can be combined, or mixed, and then processed (by a transformer/attenuator network), to be provided to a single transducer. That single transducer produces a vibration based on the signals from all of the channels, which is passed into the inner ear, which in turn provides a signal to the auditory cortex of the brain (via nerve VIII), where it is perceived as speech.

Figure 4:
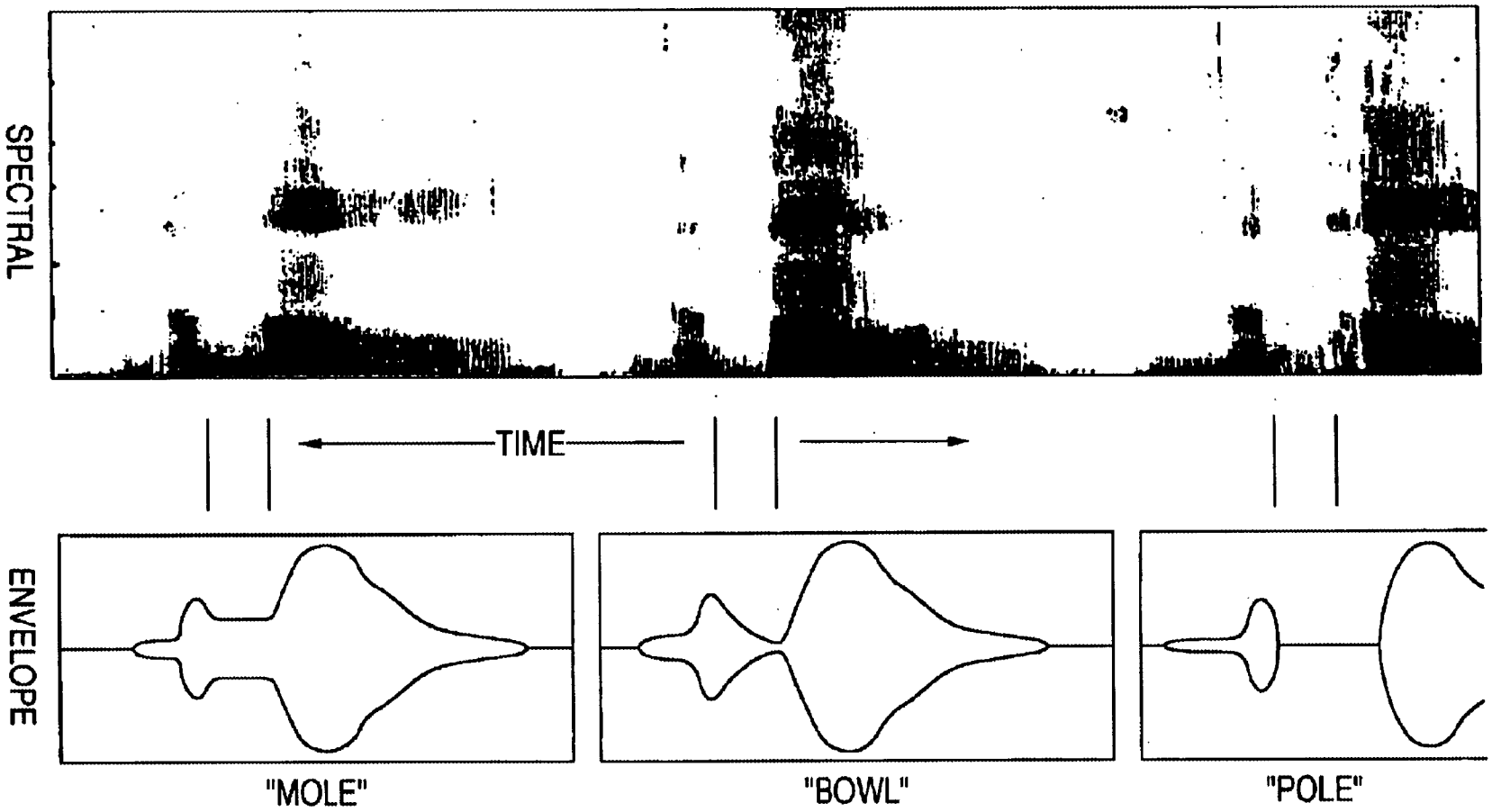
FIG. 4 shows the frequency spectra and envelope for the words "mole", "bowl" and "pole"
Figure 5:
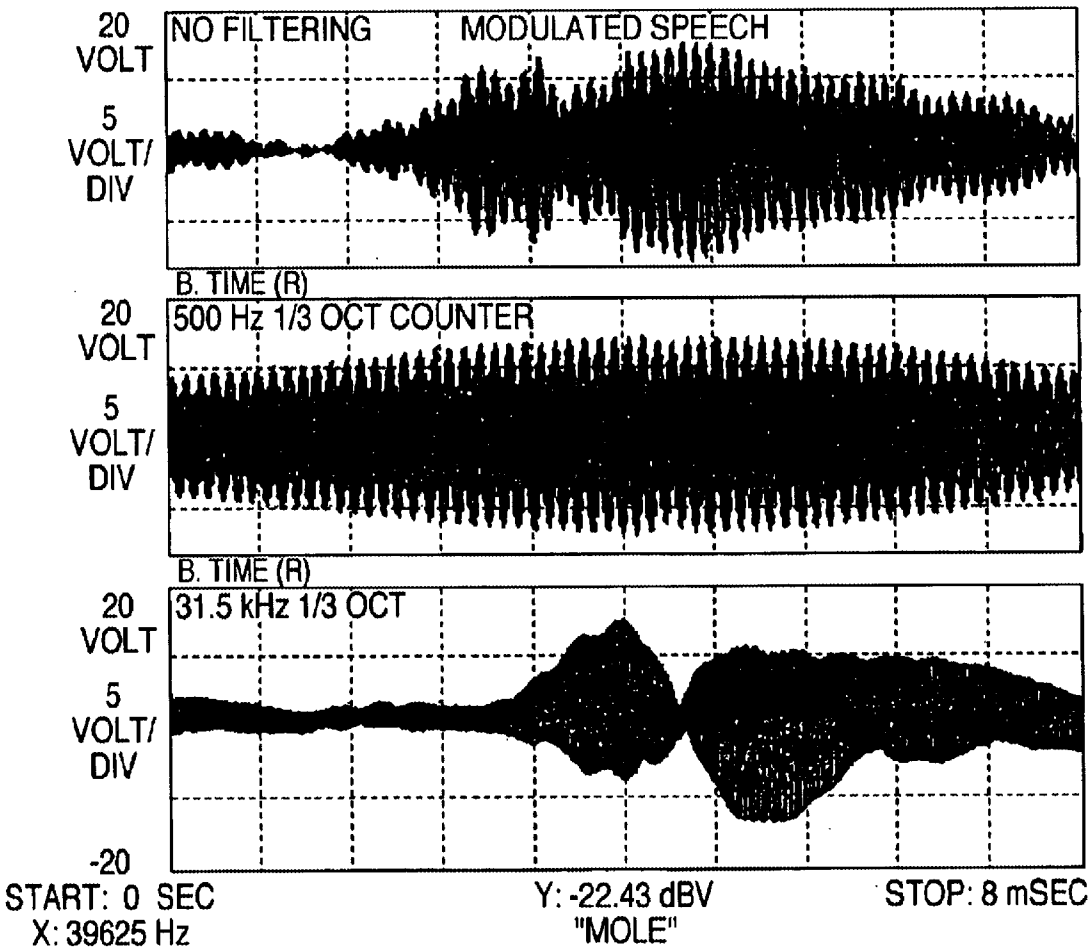
FIGS. 5–7 show the output of a three-channel upper audio range hearing aid according to the invention, for the words "mole", "bowl" and "pole"
Figure 6:
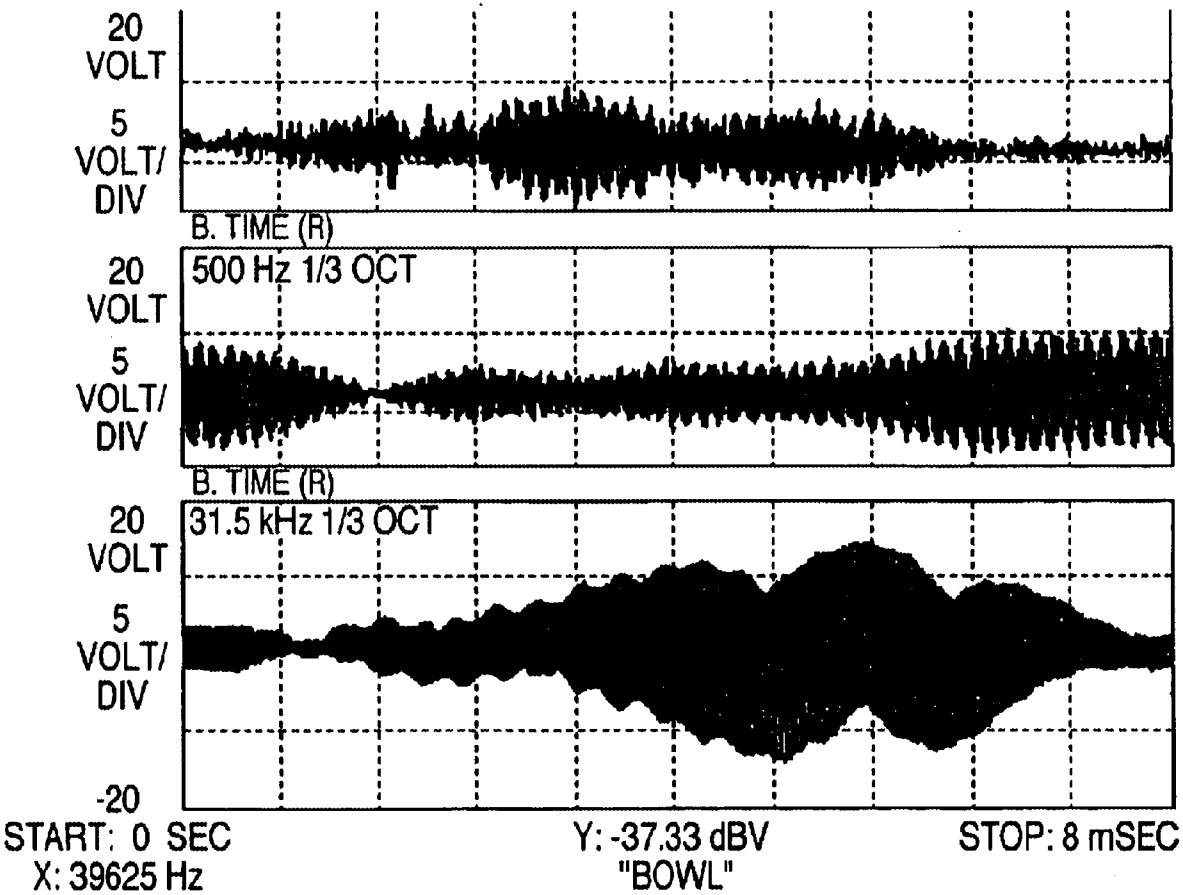
Figure 7:
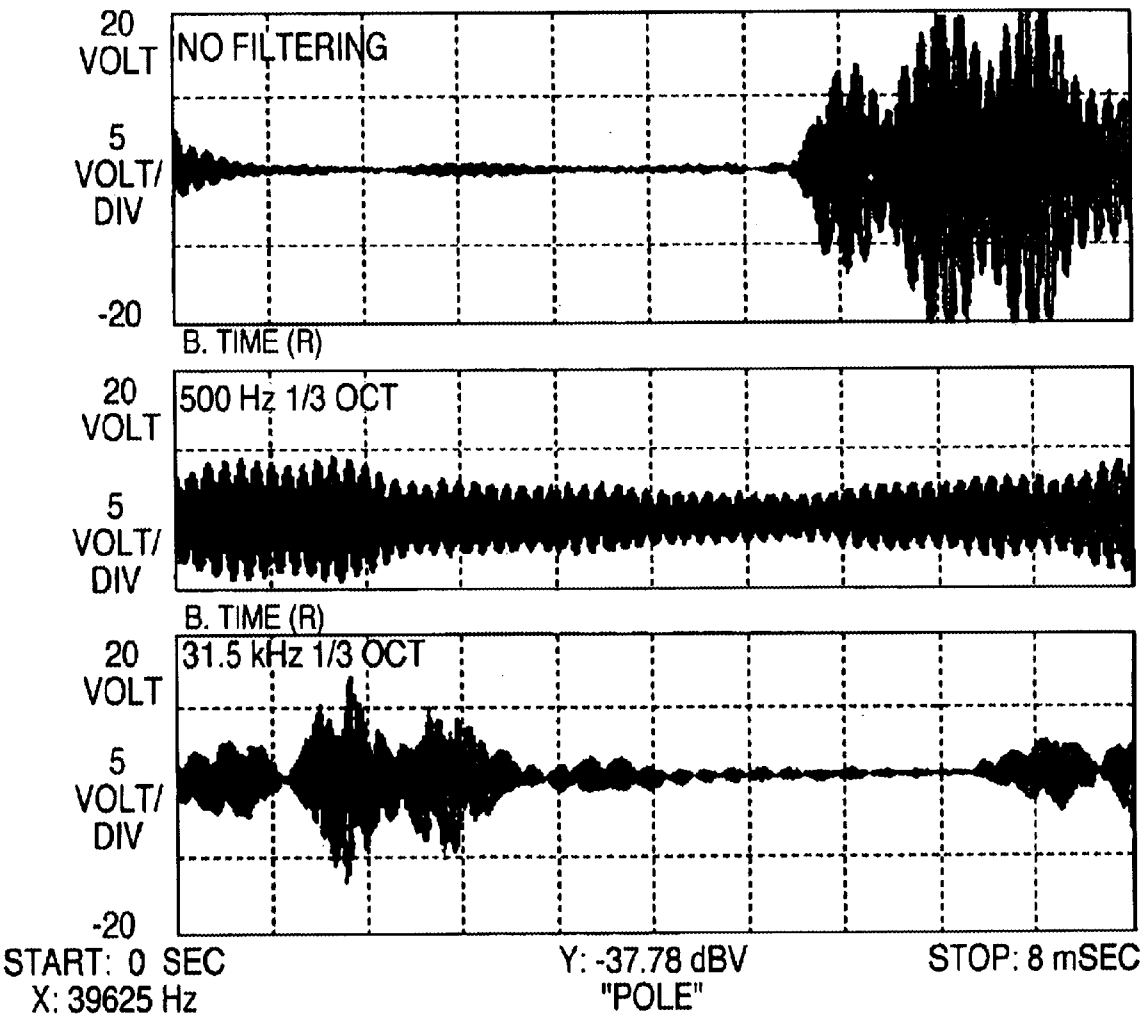
Figure 8:
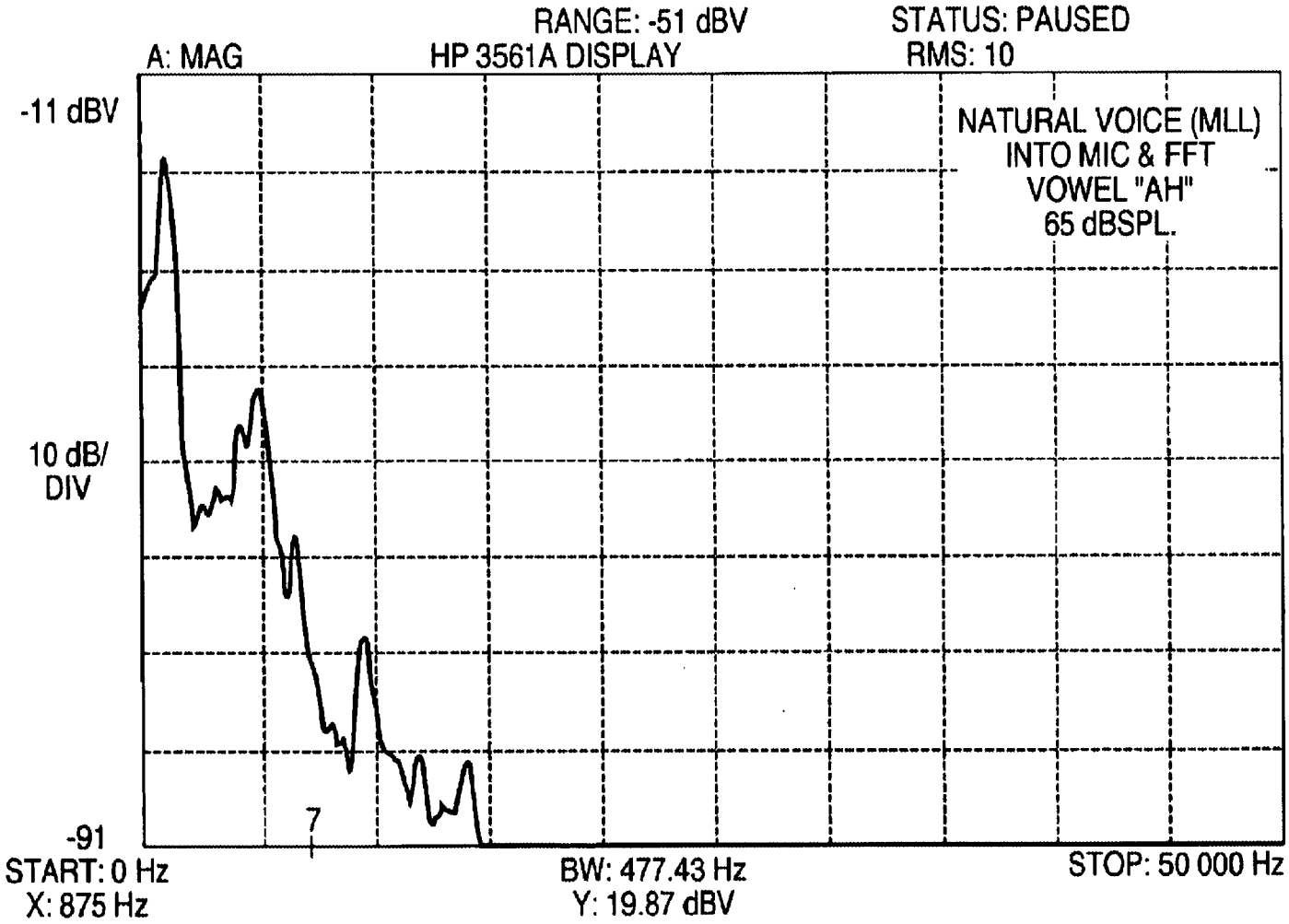
FIGS. 8–12 show the frequency spectrum of the vowel "ah" with no conversion, conversion using a 5 kHz carrier, conversion using a 10 kHz carrier, conversion using a 15 kHz carrier, and conversion using a 20 kHz carrier, respectively.
Figure 9:
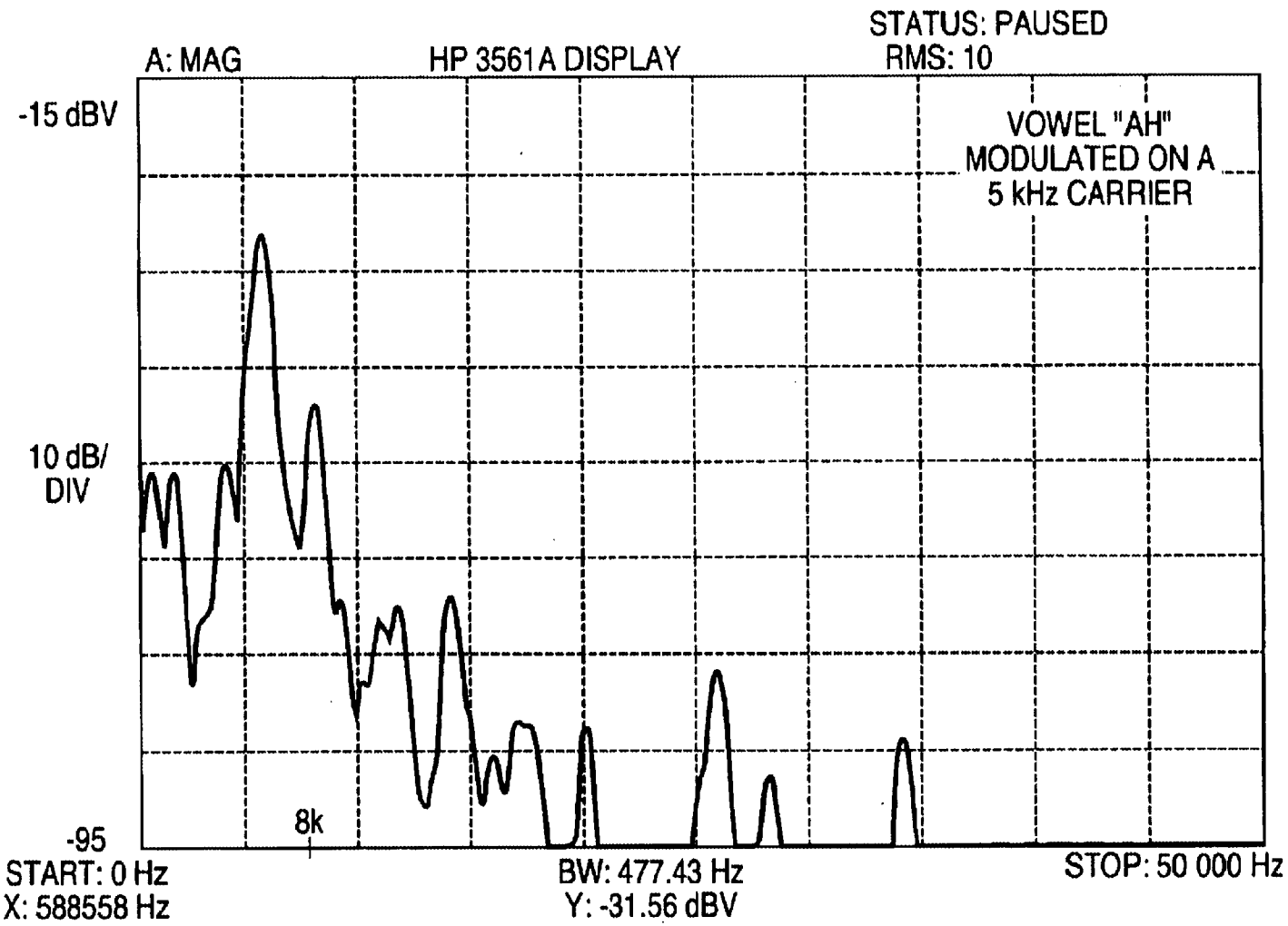
Figure 10:
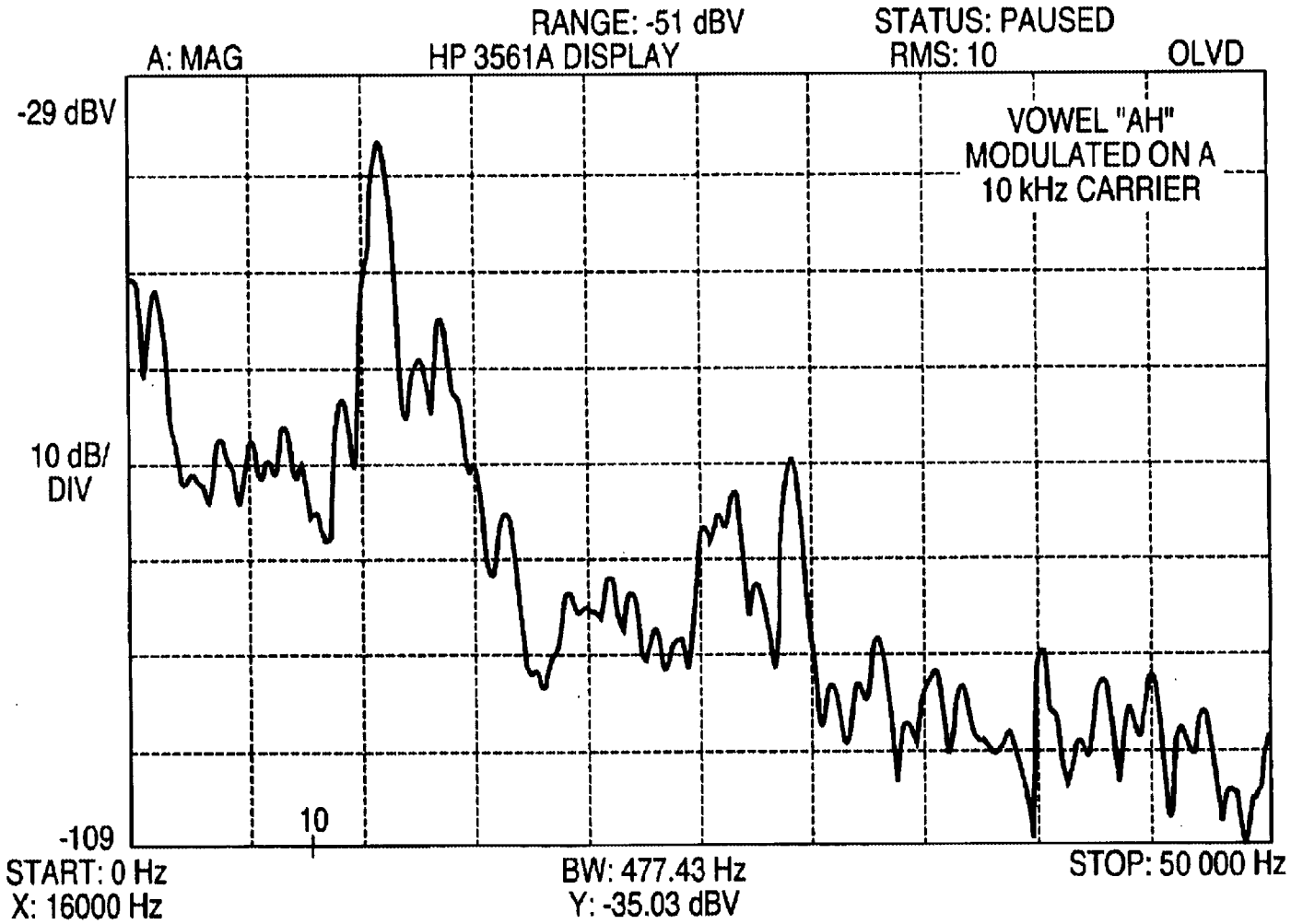
Figure 11:
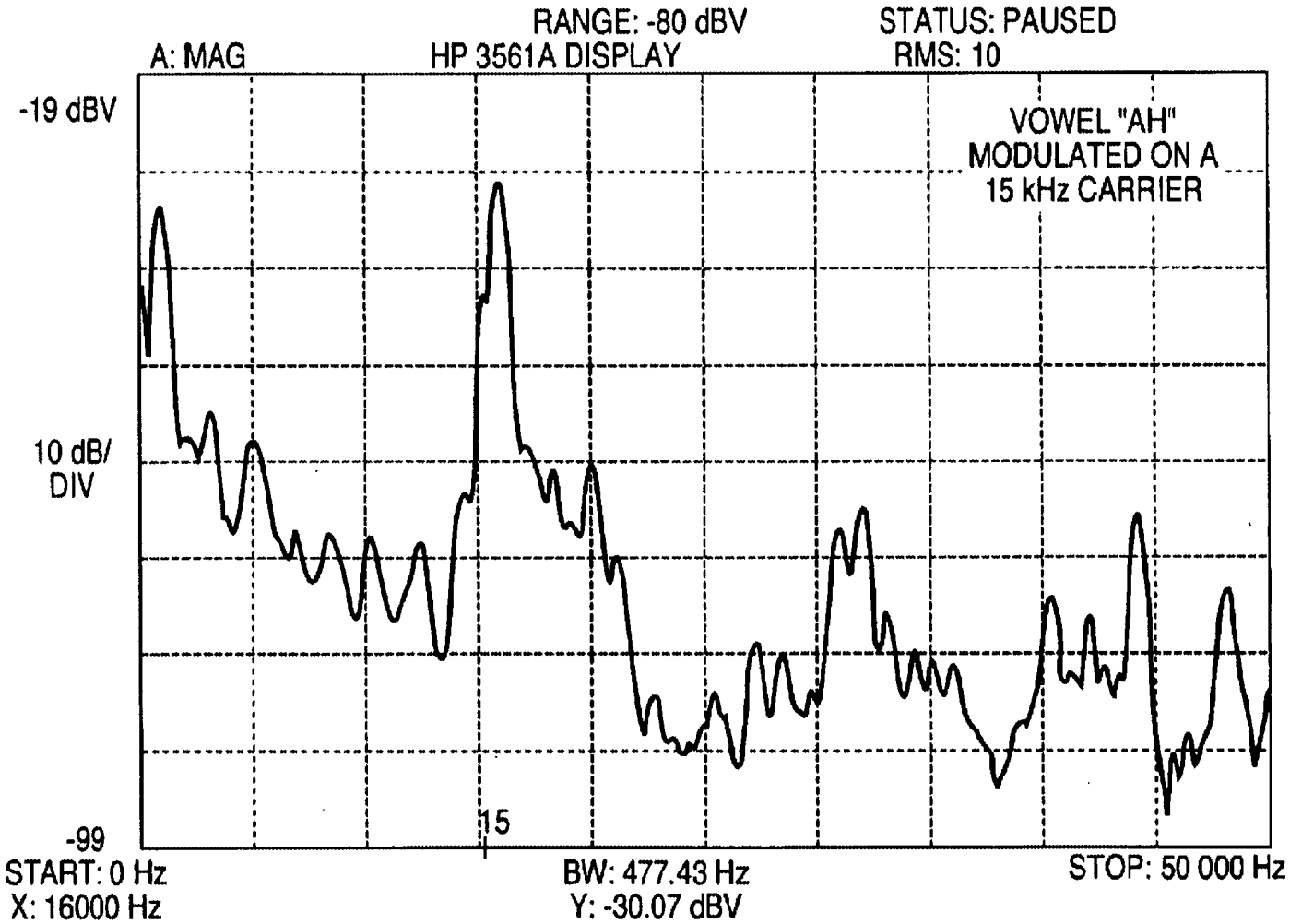
Figure 12:
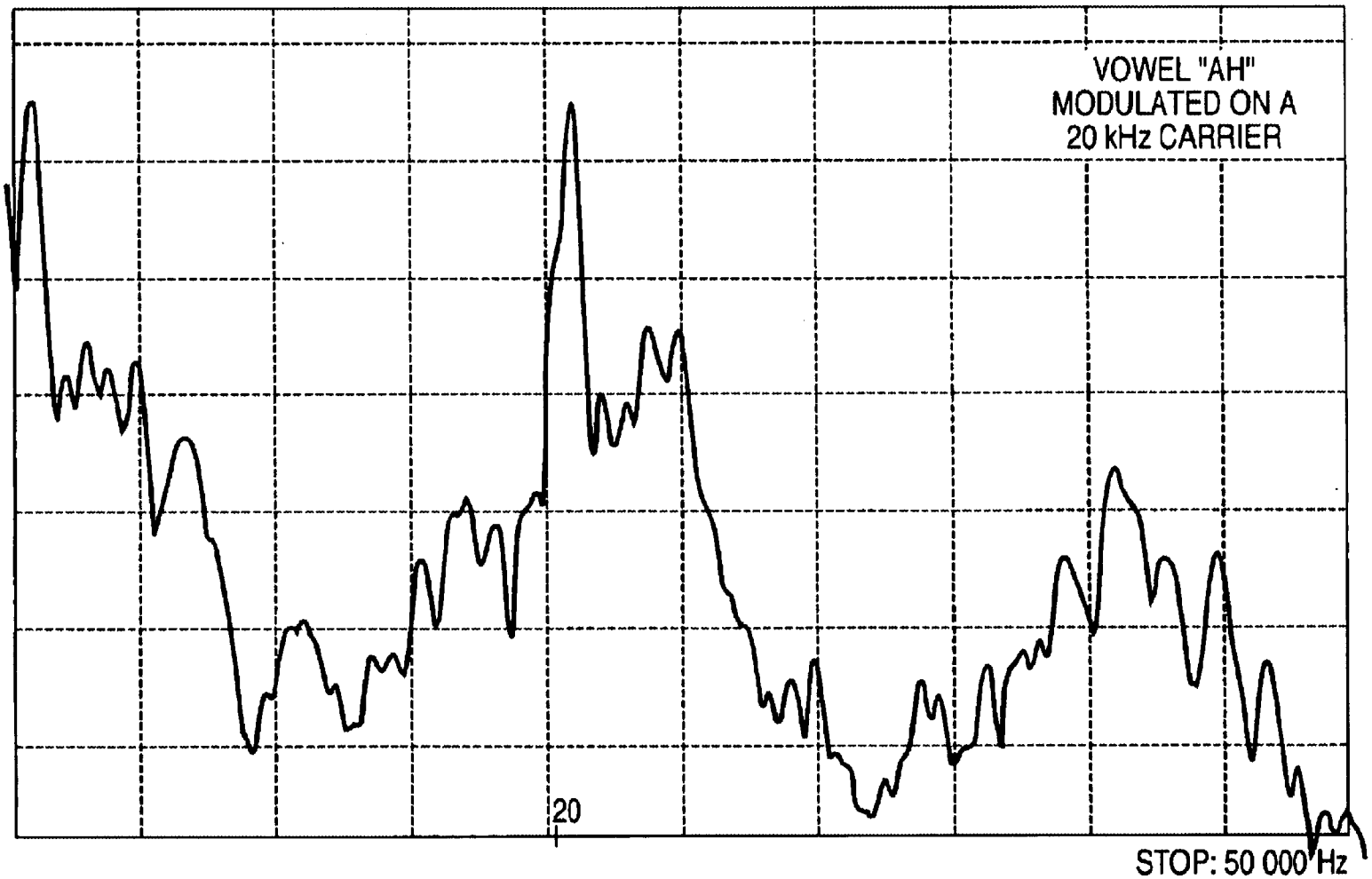

FIG. 4 shows the frequency spectra and envelope of the words "mole", "bowl", and "pole", for conventional speech in the audible frequency range. FIGS. 5, 6 and 7 shows the output of a three-channel UAR hearing aid according to the invention, for inputs of the words "mole", "bowl", and "pole", respectively. These results were based on a first channel in which no filtering was provided, a second channel that used a ⅓ octave band with a center frequency at 500 Hz, and a third channel that used a ⅓ octave band with a center frequency at 3,100 Hz. The filter for the second channel is designed for vowel sounds, and the filter for the third channel is designed for consonant sounds. The envelopes of these channel outputs are then extracted by an envelope extractor, and those envelopes are converted to the upper audio frequency range by either amplitude modulation (am), frequency modulation (fm), upper-sideband modulation, single-sideband modulation, full am, or the like. These modulated signals can be combined and then amplified by an amplifier/transformer unit, or they can be separately amplified by an amplifier/transformer array. The amplifier/transformed signal(s) is/are then provided to a transducer unit/array, which is fitted on the head or neck of a user.

FIGS. 8–12 respectively show the spectra of the sound "ah" for: a) manual voice (no modulation), b) 5 kHz carrier, c) 10 kHz carrier, d) 15 kHz carrier, and e) 20 kHz carrier. As shown in these figures, the envelope of the sound "ah" stays substantially the same regardless of the carrier used. Therefore, based on the envelope of the speech signal corresponding to the sound "ah" that has been upconverted to the UAR frequency range, the brain's auditory cortex is able to process the spoken sound "ah".

FIG. 1 shows a UAR hearing aid according to the second embodiment of the invention, in which speech is received by a microphone 110. The output of the microphone 110 is provided to a plurality of filters 120-1, 120-2, . . . , 120-n. The output of the microphone 110 is also provided to an input speech preamplifier 130, which does not filter the speech, as is done in the other channels 120-1, 120-2, . . . ,

120-n. The preamplifier 130 provides speech directly to an optional mixer 140 or to a transformer/attenuator network 185 if the mixer 140 is not provided. That way, both UAR speech and original speech is provided to the inner ear of the user.

Each channel 120-1, 120-2, . . . , 120-n has a filter that has a passband and center frequency at a different portion of the audio (or audible) frequency range. That way, certain portions of the audible speech range can be either emphasized or attenuated, as desired. The outputs of each channel are provided to an envelope extractor 160, which includes a plurality of extractors provided on a one-to-one basis for the plurality channels. Each envelope extractor is operable to extract the envelope of the output of the corresponding channel. Envelope extractors are readily available, and a discussion of such elements is not provided herein. For example, an RC filter having an appropriate time constant may be used to extract the envelope of a filtered speech signal.

The extracted envelopes are then provided to a multi-channel frequency multiplication network 170, where each extracted envelope is separately modulated and frequency converted to a UAR frequency. As discussed above, various types of modulation techniques, such as am, fm, double-sideband modulation, full am, single-sideband modulation, or the like, may be utilized. The modulated signals also may be amplified, as required, in the multiplication network 170. The output of the multiplication network 170 is shown as being provided to the optional mixer 140. In the second embodiment shown in FIG. 1, the mixer 140 mixes or combines each of the UAR signals, as well as the unmodulated speech signal received from preamplifier 130. The output of the mixer 140 is provided to a transformer/attenuator array 185, where the unmodulated speech signal is amplified, attenuated, or processed based on commands received over-the-air by a radio frequency receiver (not shown) in the transformer/attenuator array 185. Those commands are output by way of a hand-held programmer 188. If a mixer is not provided, then the separate UAR signals and the non-UAR signal (output from preamplifier 130) are separately provided to the transformer/attenuator array 185, which is configured to separately process each of the received signals based on commands received by way of the hand-held programmer 188.

The transducer unit 150 provides vibrations based on the input signals to that unit. Preferably, the transducer unit 150 is made up of one or more piezoelectric devices. If a mixer is used, the transducer unit 150 corresponds to a single transducer. If a mixer is not used, then the outputs of the transformer/attenuator array 185 are separately provided to a bank of transducers within the transducer unit 150. The vibrations caused by the transducer/transducers are received in the inner ear 195, where they are processed and provided to the brain 195 and interpreted as intelligible speech. The transducer unit 150 may be phase or otherwise manipulated to result in an acceptable sound image for the listener. As shown in the bottom part of FIG. 1, the transducer unit 150 may be disposed on the head or neck of the user, or it may be disposed, as shown by transducer unit 199, in the ear canal, where it is in contact with the walls of the ear canal. Transducer unit 199 produces vibrations of the canal wall, as well as sound in the canal. Transducer unit 199 can alternatively be used together with transducer unit 150 in another possible implementation.

Although certain embodiments of the invention have some things in common with the supersonic, bone conduction hearing aid disclosed in U.S. Pat. No. 4,982,434, which is incorporated in its entirety herein by reference, these are important differences. The UAR hearing aid according to the invention differs from the supersonic hearing aid in that, for certain embodiments of the invention, both air and bone conducted signals are provided to the ear. Also, for certain embodiments of the invention, the UAR hearing aid is a multi-channel instrument that allows the brain to combine correlated waveforms, which have been extracted from the same speech signal, into precepts of the original speech band, by relying on the amplitude time information and not the spectrum to accomplish this task. Also, the supersonic hearing does not use the low ultrasonic frequency range (<30 kHz), as in the embodiments of the invention. Furthermore, in the embodiments that use the audio speech signal along with the UAR signals, the supersonic hearing aid does not incorporate such an audio signal to be provided with other signals in speech perception. The present invention also differs from other speech envelope extracting systems in that the present invention is high frequency and low ultrasonic (10–30 kHz) and that no speech waveform rectifier is necessary in that biorectification is present.

The present invention allows for preferentially amplifying envelope aspects of the full speech signal to enhance perception as high frequency consonants. These sound units are often overshadowed by vowel energy in the single channel hearing aids and, as a result, intelligibility of speech is lowered. The embodiments of the invention also are designed to serve as an augmentation to normal communications systems in high noise areas. The speech envelope cues used in the embodiments of the invention are resistant to audio noise masking, and helps reduce ambiguity in audio speech.

While preferred embodiments have been described herein, modification of the described embodiments may become apparent to those of ordinary skill in the art, following the teachings of the invention, without departing from the spirit and scope of the invention as set forth in the appended claims. The embodiments of the invention are based on the concept that ultrasonic speech decoding is based on spectra cues (hence the need for frequency expansion to increase intelligibility), and can be either a single-channel or a multi-channel device. Certain embodiments of the invention also are based on the use of amplitude cues to enhance intelligibility, by combining several channels, as is done in the second embodiment.

Also, while the multi-channeled second embodiment was explained with reference to three channels, one of ordinary skill in the art will recognize that any number of channels may be utilized while remaining with the spirit and scope of the invention, and the specific filters for each channel may be chosen with different passbands as well.

What is claimed is:

1. An upper audio range hearing aid, comprising:

at least one channel with a filter that receives a sound signal and outputs a filtered signal;

a second channel with a second filter that is tuned to a different frequency than the filter in the at least one channel;

a modulation unit that separately modulates outputs of the at least one channel and the second channel to within the upper audio frequency range and to thereby output a first and second modulated signal, respectively; and a vibration unit configured to vibrate in accordance with the modulated signal provided thereto;

wherein the vibration unit includes a first vibrator configured to vibrate based on the first modulated signal, and a second vibrator configured to vibrate based on the second modulated signal, and is affixed to at least one of an ear canal, a head and a neck of a user, and provides a vibration that is received by an inner ear of the user and is provided to a brain of the user and decoded as intelligible speech.

2. The upper audio frequency range hearing aid according to claim 1, wherein the vibration unit is affixed to the user at a location in or adjacent to an ear of the user.

3. The upper audio frequency range hearing aid according to claim 1, further comprising a third channel configured to receive the sound signal and to provide the sound signal directly to the vibration unit as an unmodulated signal.

4. The upper audio frequency range hearing aid according to claim 1, further comprising:

an envelope extractor configured to extract an envelope of the filtered signal and to provide the envelope-extracted signal to the modulation unit.

5. The upper audio frequency range hearing aid according to claim 1, wherein, when the vibration unit is affixed to the ear canal, the vibration unit provides sound signals via bone conduction and via air conduction.

6. The upper audio frequency range hearing aid according to claim 5, wherein the sound signals provided via bone conduction are sent by wall of vibration of at least one wall of the ear canal that touches the vibration unit.

7. The upper audio range hearing aid according to claim 1, wherein the upper audio range corresponds to a frequency range of between 10 kHz and 20 kHz.

8. The upper audio range hearing aid according to claim 7, wherein both bone conduction audiometric signals and air conduction audiometric signals are provided to the brain of the user and are decoded as intelligible speech.

* * * * *